US010558132B2

(12) United States Patent
Ishiduka et al.

(10) Patent No.: US 10,558,132 B2
(45) Date of Patent: Feb. 11, 2020

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yuka Ishiduka, Suntou-gun (JP); Tsutomu Nishida, Mishima (JP); Atsushi Okuda, Yokohama (JP); Hiroyuki Watanabe, Suntou-gun (JP); Hideharu Shimozawa, Numazu (JP); Nobuhiro Nakamura, Numazu (JP); Kenichi Kaku, Suntou-gun (JP); Daisuke Miura, Tokyo (JP); Koichi Nakata, Tokyo (JP); Masaki Nonaka, Toride (JP); Koji Takahashi, Kashiwa (JP); Haruki Mori, Ichikawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/423,337

(22) Filed: May 28, 2019

(65) Prior Publication Data

US 2019/0369511 A1 Dec. 5, 2019

(30) Foreign Application Priority Data

May 31, 2018 (JP) ..... 2018-105583

(51) Int. Cl.
*G03G 5/07* (2006.01)
*G03G 5/05* (2006.01)

(52) U.S. Cl.
CPC ..... *G03G 5/0525* (2013.01); *G03G 5/075* (2013.01)

(58) Field of Classification Search
CPC .. G03G 5/147; G03G 5/14734; G03G 5/0614; G03G 5/071
See application file for complete search history.

(56) References Cited

U.S. PATENT DOCUMENTS 6,991,881 B2 1/2006 Ogaki et al.
6,994,941 B2 2/2006 Tanaka et al.
(Continued)

FOREIGN PATENT DOCUMENTS

JP 2010-085832 4/2010
JP 2010-170077 8/2010
JP 2015-225132 12/2015

OTHER PUBLICATIONS

U.S. Appl. No. 16/423,326, Hiroyuki Watanabe, filed May 28, 2019.
(Continued)

*Primary Examiner* — Peter L Vajda
(74) *Attorney, Agent, or Firm* — Venable LLP

(57) ABSTRACT

An electrophotographic photosensitive member includes a support and a surface layer, in which the surface layer contains a copolymer of a composition which contains at least a compound represented by the following general formula (1) and a compound represented by the following general formula (2), a content of the compound represented by the general formula (1) in the composition is 25 mass % or more and 70 mass % or less with respect to a total content of the compound represented by the general formula (1) and the compound represented by the general formula (2), and the total content of the compound represented by the general formula (1) and the compound represented by the general formula (2) is 55 mass % or more with respect to a total mass of the composition.

5 Claims, 1 Drawing Sheet

(56) References Cited

U.S. PATENT DOCUMENTS

| | | | |
|---|---|---|---|
| 7,001,699 | B2 | 2/2006 | Tanaka et al. |
| 7,045,261 | B2 | 5/2006 | Tanaka et al. |
| 7,186,489 | B2 | 3/2007 | Uematsu et al. |
| 7,226,711 | B2 | 6/2007 | Amamiya et al. |
| 7,333,752 | B2 | 2/2008 | Kawahara et al. |
| 7,534,534 | B2 | 5/2009 | Nakata et al. |
| 7,585,604 | B2 | 9/2009 | Ogaki et al. |
| 7,645,547 | B2 | 1/2010 | Okuda et al. |
| 7,655,370 | B2 | 2/2010 | Kitamura et al. |
| 7,704,657 | B2 | 4/2010 | Uesugi et al. |
| 7,799,496 | B2 | 9/2010 | Uesugi et al. |
| 7,910,274 | B2 | 3/2011 | Tanaka et al. |
| 7,927,774 | B2 | 4/2011 | Ogaki et al. |
| 8,088,541 | B2 | 1/2012 | Tanaka et al. |
| 8,415,078 | B2 | 4/2013 | Tanaka et al. |
| 8,455,170 | B2 | 6/2013 | Nakamura et al. |
| 8,457,528 | B2 | 6/2013 | Ochi et al. |
| 8,481,236 | B2 | 7/2013 | Tanaka et al. |
| 8,632,935 | B2 | 1/2014 | Sugiyama et al. |
| 8,669,027 | B2 | 3/2014 | Anezaki et al. |
| 8,753,789 | B2 | 6/2014 | Ogaki et al. |
| 8,765,335 | B2 | 7/2014 | Tanaka et al. |
| 8,783,209 | B2 | 7/2014 | Kaku et al. |
| 8,815,479 | B2 | 8/2014 | Shida et al. |
| 8,846,281 | B2 | 9/2014 | Okuda et al. |
| 8,865,380 | B2 | 10/2014 | Noguchi et al. |
| 8,865,381 | B2 | 10/2014 | Tanaka et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,114,565 | B2 | 8/2015 | Kawai et al. |
| 9,170,506 | B2 | 10/2015 | Tanaka et al. |
| 9,170,507 | B2 | 10/2015 | Sugiyama et al. |
| 9,188,888 | B2 | 11/2015 | Okuda et al. |
| 9,207,550 | B2 | 12/2015 | Okuda et al. |
| 9,244,369 | B2 | 1/2016 | Tanaka et al. |
| 9,274,442 | B2 | 3/2016 | Sato et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,414 | B2 | 4/2016 | Miura et al. |
| 9,304,416 | B2 | 4/2016 | Noguchi et al. |
| 9,316,931 | B2 | 4/2016 | Takagi et al. |
| 9,341,964 | B2 | 5/2016 | Ogaki et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,389,521 | B2 | 7/2016 | Takahashi et al. |
| 9,389,523 | B2 | 7/2016 | Nakata et al. |
| 9,436,106 | B2 | 9/2016 | Kuno et al. |
| 9,436,107 | B2 | 9/2016 | Murakami et al. |
| 9,459,545 | B2 | 10/2016 | Tanaka et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,563,139 | B2 | 2/2017 | Kawahara et al. |
| 9,575,422 | B2 | 2/2017 | Okuda et al. |
| 9,594,318 | B2 | 3/2017 | Nakata et al. |
| 9,599,915 | B2 | 3/2017 | Anezaki et al. |
| 9,599,917 | B2 | 3/2017 | Okuda et al. |
| 9,645,515 | B2 | 5/2017 | Kuno et al. |
| 9,645,516 | B2 | 5/2017 | Kawahara et al. |
| 9,684,277 | B2 | 6/2017 | Yamamoto et al. |
| 9,726,992 | B2 | 8/2017 | Sakuma et al. |
| 9,740,117 | B2 | 8/2017 | Kosaka et al. |
| 9,766,561 | B2 | 9/2017 | Takahashi et al. |
| 9,772,596 | B2 | 9/2017 | Mitsui et al. |
| 9,791,792 | B2 | 10/2017 | Miyauchi et al. |
| 9,851,646 | B2 | 12/2017 | Tomono et al. |
| 9,869,032 | B2 | 1/2018 | Kawahara et al. |
| 10,042,272 | B2 | 8/2018 | Mori et al. |
| 10,042,273 | B2 | 8/2018 | Takahashi et al. |
| 10,073,362 | B2 | 9/2018 | Fujii et al. |
| 10,120,331 | B2 | 11/2018 | Nakata et al. |
| 10,162,278 | B2 | 12/2018 | Kuno et al. |
| 10,203,617 | B2 | 2/2019 | Kuno et al. |
| 10,303,085 | B2 | 5/2019 | Sato et al. |
| 10,310,395 | B2 | 6/2019 | Nakata et al. |
| 2005/0208402 | A1 | 9/2005 | Tanaka et al. |
| 2011/0195354 | A1 | 8/2011 | Nukada et al. |
| 2012/0202146 | A1* | 8/2012 | Yamada ..... G03G 5/0589 430/56 |
| 2012/0301178 | A1 | 11/2012 | Nonaka et al. |
| 2014/0004450 | A1 | 1/2014 | Tokimitsu et al. |
| 2014/0093281 | A1 | 4/2014 | Takahashi et al. |
| 2014/0212800 | A1 | 7/2014 | Miura et al. |
| 2015/0185630 | A1 | 7/2015 | Ito et al. |
| 2015/0185634 | A1 | 7/2015 | Sekiya et al. |
| 2015/0316863 | A1 | 11/2015 | Tanaka et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2017/0060008 | A1 | 3/2017 | Okuda et al. |
| 2018/0059558 | A1 | 3/2018 | Ito et al. |
| 2018/0329317 | A1 | 11/2018 | Mori et al. |
| 2018/0335708 | A1 | 11/2018 | Nakata et al. |
| 2018/0341190 | A1 | 11/2018 | Nishi et al. |
| 2018/0356745 | A1 | 12/2018 | Takahashi et al. |
| 2019/0049867 | A1 | 2/2019 | Tokimitsu et al. |
| 2019/0056676 | A1 | 2/2019 | Nakata et al. |
| 2019/0094726 | A1 | 3/2019 | Mori et al. |
| 2019/0163118 | A1 | 5/2019 | Iwasaki et al. |
| 2019/0163119 | A1 | 5/2019 | Yamaai et al. |
| 2019/0163120 | A1 | 5/2019 | Miura et al. |

OTHER PUBLICATIONS

U.S. Appl. No. 16/423,381, Atsushi Okuda, filed May 28, 2019.
U.S. Appl. No. 16/423,393, Tsutomu Nishida, filed May 28, 2019.
U.S. Appl. No. 16/423,418, Hiroyuki Watanabe, filed May 28, 2019
U.S. Appl. No. 16/423,429, Nobuhiro Nakamura, filed May 28, 2019.
U.S. Appl. No. 16/272,268, Hideharu Shimozawa, filed Feb. 11, 2019.
U.S. Appl. No. 16/286,762, Nobuhiro Nakamura, filed Feb. 27, 2019.
U.S. Appl. No. 16/287,102, Tsutomu Nishida, filed Feb. 27, 2019.
U.S. Appl. No. 16/416,929, Haruki Mori, filed May 20, 2019.
U.S. Appl. No. 16/423,292, Yasutaka Yagi, filed May 28, 2019.
U.S. Appl. No. 16/430,860, Koichi Nakata, filed Jun. 4, 2019.

* cited by examiner

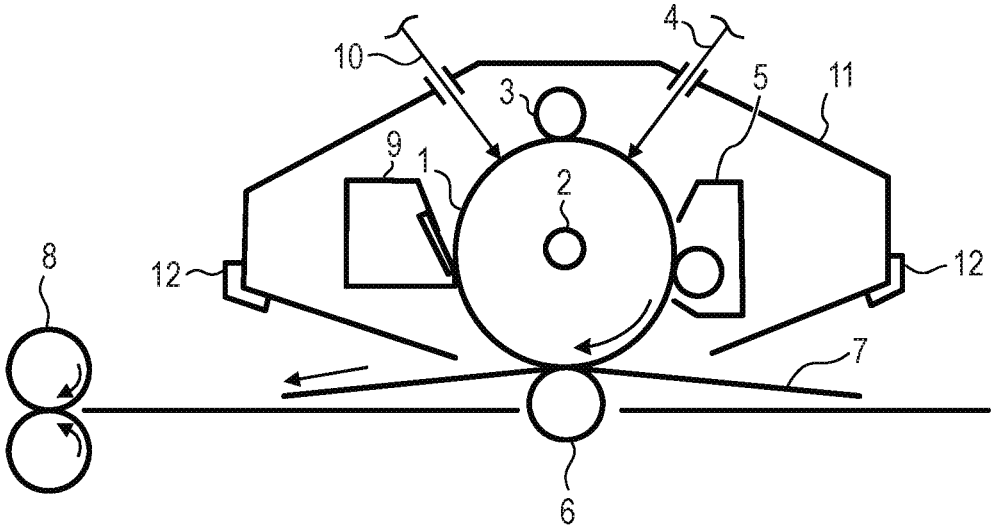
10
4
3
5
11
9
1
2
8
12
12
7
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge having the electrophotographic photosensitive member, and an electrophotographic apparatus having the electrophotographic photosensitive member.

Description of the Related Art

Various studies have been conducted on an electrophotographic photosensitive member mounted on an electrophotographic apparatus in order to improve image quality and durability. As an example, there is a study to improve abrasion resistance (mechanical durability) by using a radical polymerizable resin for a surface layer of the electrophotographic photosensitive member (hereinafter, also referred to as a photosensitive member). Although such a surface layer has high abrasion resistance, it is likely to cause deep scratches and image defects due to foreign matters such as external additives and paper powder. In order to suppress the occurrence of the deep scratches, Japanese Patent Application Laid-Open No. 2015-225132 discloses using a triarylamine compound having one methacryloyloxy group. Japanese Patent Application Laid-Open No. 2010-170077 also discloses using a triarylamine compound having four or more methacryloyloxy groups.

SUMMARY OF THE INVENTION

The above object is achieved by the present invention described below. That is, an electrophotographic photosensitive member according to the present invention is an electrophotographic photosensitive member which includes a support and a surface layer, in which the surface layer contains a copolymer of a composition which contains at least a compound represented by the following general formula (1) and a compound represented by the following general formula (2), a content of the compound represented by the general formula (1) in the composition is 25 mass % or more and 70 mass % or less with respect to a total content of the compound represented by the general formula (1) and the compound represented by the general formula (2), and the total content of the compound represented by the general formula (1) and the compound represented by the general formula (2) is 55 mass % or more with respect to a total mass of the composition:

General Formula (1)

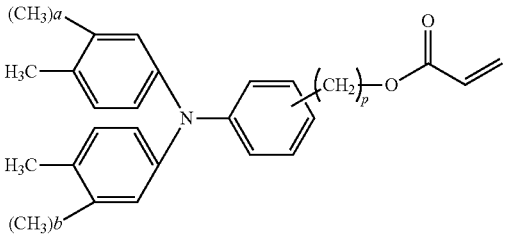

-continued

General Formula (2)

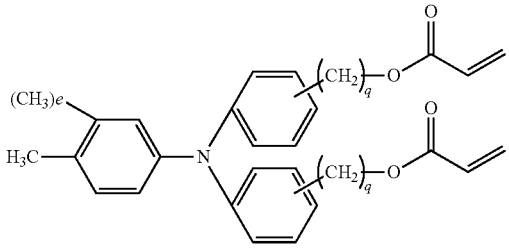

in the general formula (1), a and b are 0 or 1, p is an integer of 2 or more and 5 or less, in the general formula (2), e is 0 or 1, q is an integer of 2 or more and 5 or less, however, at least one of a, b, and e is 1.

In addition, a process cartridge according to the present invention integrally supports the electrophotographic photosensitive member and at least one units selected from the group consisting of a charging unit, a developing unit, a transfer unit, and a cleaning unit, and is detachably attachable to a main body of an electrophotographic apparatus.

In addition, an electrophotographic apparatus according to the present invention includes the electrophotographic photosensitive member, a charging unit, an exposure unit, a developing unit, and a transfer unit.

Further features of the present invention will become apparent from the following description of exemplary embodiments with reference to the attached drawings.

BRIEF DESCRIPTION OF THE DRAWINGS

FIGURE is a diagram illustrating an example of a schematic configuration of an electrophotographic apparatus having a process cartridge provided with an electrophotographic photosensitive member.

DESCRIPTION OF THE EMBODIMENTS

According to the study of the present inventors, it has been found that the configuration disclosed in Japanese Patent Application Laid-Open No. 2015-225132 may cause deep scratches due to a repeated use in a low temperature and low humidity environment. It is considered that the reason is that paper surrounding the photosensitive member, paper powder, and in some cases, a cleaning blade, a charging roller, and the like become hard due to a temperature drop and are easily pushed into the photosensitive member to easily cause deep scratches.

In addition, the configuration disclosed in Japanese Patent Application Laid-Open No. 2010-170077, does not have sufficient abrasion resistance in the repeated use under a low temperature and low humidity environment. It is considered that this is because a vibration of a triarylamine compound having four or more methacrylyloxy groups is suppressed under the low temperature and low humidity environment, and an external stress cannot be dissipated as heat and reaches a phenomenon such as scraping.

Therefore, an object of the present invention is to provide an electrophotographic photosensitive member which has high abrasion resistance and suppresses an occurrence of deep scratches in repeated use under the low temperature and low humidity environment.

Hereinafter, the present invention will be described in detail with reference to preferred embodiments.

The present inventors have considered whether there is a method for imparting a high abrasion resistance to a surface layer and furthermore suppressing deep scratches from occurring by focusing on a combination of materials that constitute a surface layer of the electrophotographic photosensitive member to select an appropriate material.

The present inventors focused on a density of a film, which constitutes the surface layer, as a factor of controlling the occurrence of the deep scratches to be suppressed and the abrasion resistance to be increased. The present inventors have considered that a probability of dissipating an external rubbing stress as heat rather than diverging the external rubbing stress as destructive energy such as abrasion is increased because a network of a polymer is made dense by increasing the density of the film. In addition, the present inventors have considered that since functional groups are present uniformly and unevenness of surface free energy can be reduced by making a network dense, adhesion of foreign matters can be suppressed and the occurrence of deep scratches can be suppressed.

The configuration of the electrophotographic photosensitive member according to one aspect of the present invention is as follows. The electrophotographic photosensitive member has a support and a surface layer, in which the surface layer contains a copolymer of a composition which contains at least a compound represented by the following general formula (1) and a compound represented by the following general formula (2), a content of the compound represented by the general formula (1) in the composition is 25 mass % or more and 70 mass % or less with respect to a total content of the compound represented by the general formula (1) and the compound represented by the general formula (2), and a total content of the compound represented by the general formula (1) and the compound represented by the general formula (2) is 55 mass % or more with respect to a total mass of the composition.

General Formula (1)

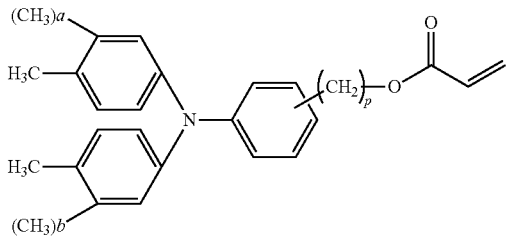

General Formula (2)

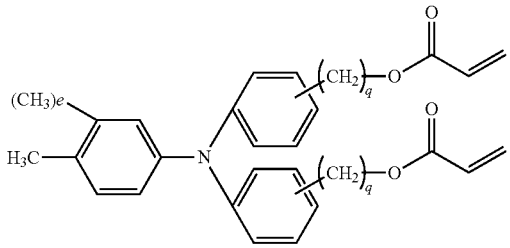

In the general formula (1), a and b are 0 or 1, p is an integer of 2 or more and 5 or less.

In the general formula (2), e is 0 or 1, q is an integer of 2 or more and 5 or less.

However, at least one of a, b, and e is 1.

Combining the compounds represented by the general formula (1) and the general formula (2) is effective for suppressing the occurrence of the deep scratches and improving the abrasion resistance.

It is further preferable that a, b, and e is a=b=1, and therefore e=0 or a=b=0 and therefore e=1. The reason is that the density of the film is considered to be increased.

Regarding the compounds represented by the general formula (1) and the general formula (2), specific exemplary compounds are shown below.

Exemplary Compound of General Formula (1)

1-1

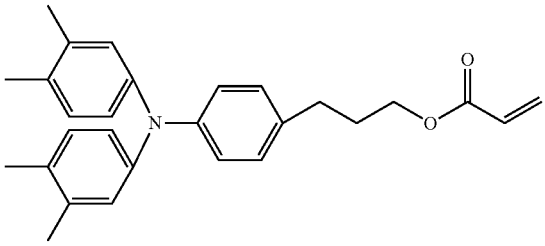

1-2

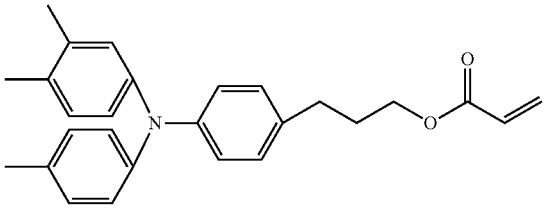

1-3

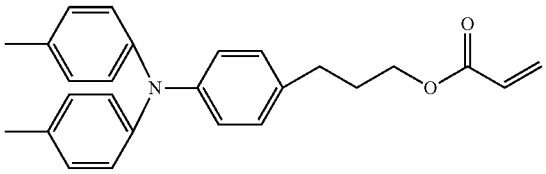

1-4

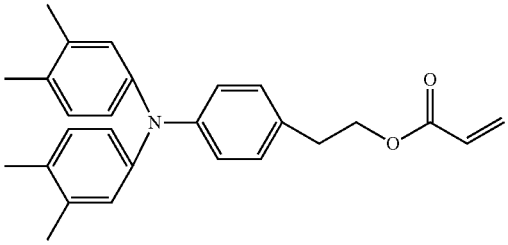

1-5

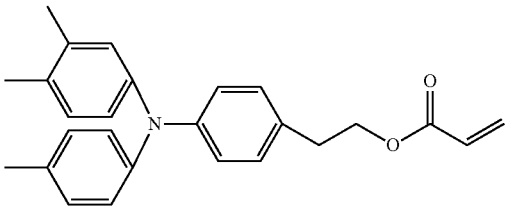

-continued 1-6

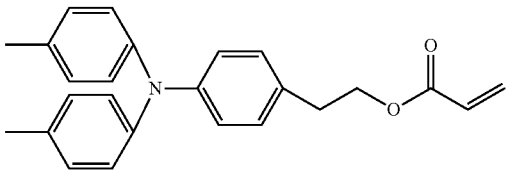

1-7

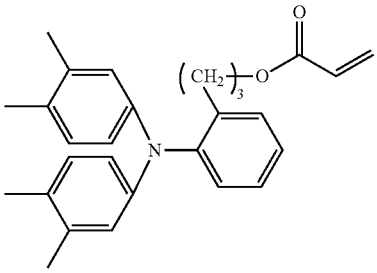

1-8

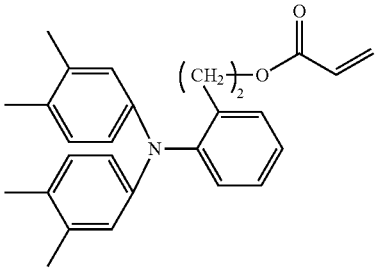

1-9

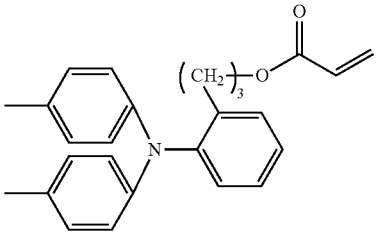

1-10

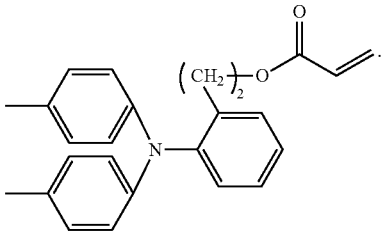

Exemplary Compound of General Formula (2)

2-1

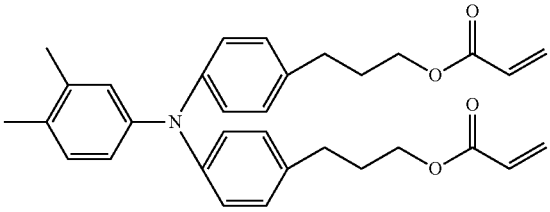

-continued 2-2

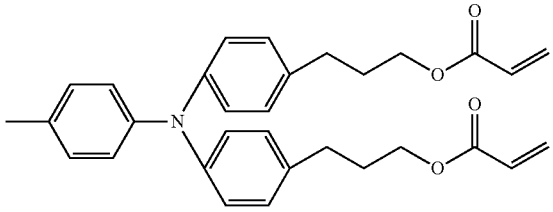

2-3

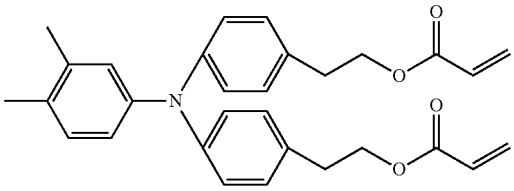

2-4

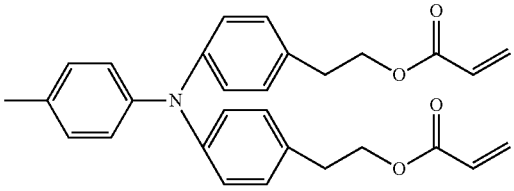

2-5

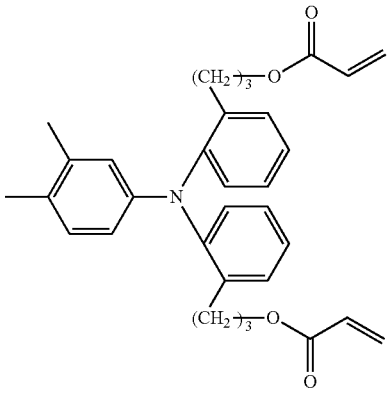

2-6

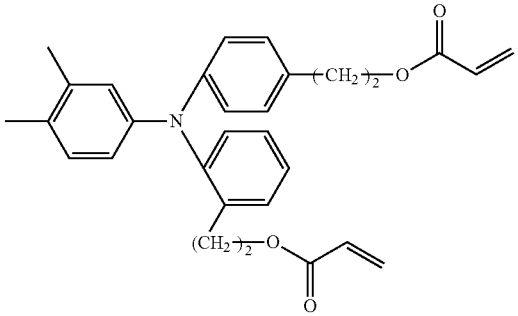

It is more preferable that the content of the compound represented by the general formula (1) in the composition is 30 mass % or more and 60 mass % or less with respect to a total content of the compound represented by the general formula (1) and the compound represented by the general formula (2).

In addition, it is more preferable that the total content of the compound represented by the general formula (1) and the compound represented by the general formula (2) is 70 mass % or more with respect to a total mass of the composition.

The present inventors estimate a mechanism capable of solving the above-mentioned technical problems by such composition as follows.

The density of the film can be increased by using a triarylamine compound having a small molecular weight as a basic skeleton of the film. Therefore, a film having a high density was produced using the triarylamine compound having a small molecular weight, and the abrasion resistance was evaluated.

A mass ratio of the triarylamine compound and the polycarbonate resin shown in Table 1 was dissolved in chlorobenzene as triarylamine compound/polycarbonate resin=7/10. Then, a film was formed by coating an aluminum sheet by a bar coater so that a film thickness is set to 20 μm and drying the aluminum sheet at 120° C./60 minutes. Thereafter, an abrasion loss was measured with a rotary Taber's abrasion resistance tester (manufactured by Yasuda Seiki Seisakusho, Ltd.). In the measurement, as a wear ring, two wear rings (trade name: CS-0, manufactured by Taber Instruments Corporation) with a wrapping film (trade name: C2000, manufactured by Fuji Film Corporation) were used, and each of the two wear rings were applied with a load of 4.9 N (500 g). A weight loss before and after rotational abrasion of each sample was measured, which was taken as a Taber abrasion loss.

It means that when a value of the abrasion loss shown in Table 1 is small, it is difficult to wear, and the film using the triarylamine compound shown by No. 1 did not have the sufficient abrasion resistance. Moreover, it was known that the film using the triarylamine compound shown by No. 2 was difficult to wear. However, since an oxidation potential is high, an exchange of charges with adjacent layers is insufficient, and since a problem occurs in charge accumulation, the film is not optimal as a structure constituting the surface layer. Next, the triarylamine compounds shown by No. 3 and No. 4 are mentioned as a structure which forms the film which is difficult to wear, and it was known that a value of the oxidation potential also has no problem.

Although the compounds in Table 1 are not polymerized, as shown by No. 3 and No. 4, it is preferable for the compounds to have at least one 3,4-xylyl group in terms of improving the abrasion resistance. It is estimated that the number of portions which can be thermally dissipated is increased as the compounds have two methyl groups.

In addition, it is considered that a compound having one polymerizable functional group with a high degree of freedom is charged into a gap by mixing a compound having one polymerizable functional group represented by the general formula (1) with a compound having two polymerizable functional groups represented by the general formula (2) in a specific range. Therefore, the film is estimated to be highly dense. In addition, since the network becomes dense, it is considered that the probability of dissipating the external rubbing stress as heat rather than diverging the external rubbing stress as destructive energy such as abrasion is increased. In addition, it is estimated that the fact that the number of parts which can be thermally dissipated is increased by having two methyl groups is one of the reasons is one of the reasons of improving the abrasion resistance.

In addition, as the density of the film is increased, the functional groups tends to be present uniformly. Therefore, it is estimated that the occurrence of deep scratches is suppressed by reducing the surface free energy difference and reducing the portion to which the foreign matters specifically adhere.

The effects of the present invention can be obtained even in a repeated use under a low temperature and low humidity environment.

In addition, when methacryloyloxy groups are used as the polymerizable functional group, the methacryloyloxy groups react preferentially with each other, and therefore, it is known that the abrasion resistance and the suppression of the occurrence of the deep scratches are insufficient under the low temperature and low humidity environment. The reason is estimated that since the network is not dense by preferentially reacting the methacryloyloxy groups with each other, the density of the film is reduced. In addition, it is estimated that a portion where the surface free energy is high is generated, and the foreign matters easily adhere. Since the adhered foreign matters are difficult to roll or slip, it is considered that foreign matters are pushed in by an external impact and the deep scratches occur.

In addition, when the surface layer contains a silicon-based or fluorine-based compound having high water repellency, these compounds easily move to the surface, an initial surface free energy is decreased, but when the compound having high water repellency present on the surface is reduced, the effect is reduced.

In addition, compounds having a molecular weight larger than that of a triarylamine compound used in the present invention tend to reduce the abrasion resistance. It is estimated that the reason is that the density is reduced.

As in the above estimation mechanism, the compound and the composition ratio constituting the copolymer of the surface layer generate a synergy effect to obtain the effects of the present invention.

TABLE 1

| No. | Triarylamine compound | Abrasion loss (mg) | Oxidation potential (eV) |
|---|---|---|---|
| 1 | 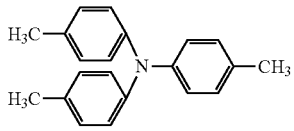 | 3.73 | 0.83 |
| 2 | 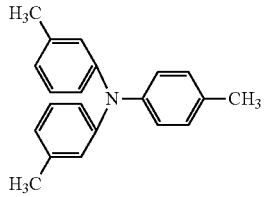 | 3.36 | 0.90 |
| 3 | 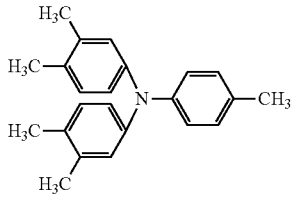 | 3.50 | 0.78 |
| 4 | 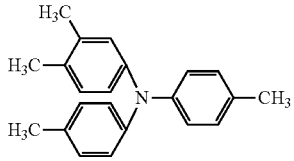 | 3.53 | 0.81 |

[Electrophotographic Photosensitive Member]

An electrophotographic photosensitive member according to one aspect of the present invention has a support and a surface layer.

As a method of producing an electrophotographic photosensitive member, there may be mentioned a method for preparing a coating solution for each layer to be described later, applying the coating solution in the order of desired layers, and drying the layers. At this time, examples of a method of applying a coating solution include dip coating, spray coating, inkjet coating, roll coating, die coating, blade coating, curtain coating, wire bar coating, ring coating, and the like. Among those, the dip coating is preferable from the viewpoint of efficiency and productivity.

Hereinafter, each layer will be described.

<Support>

In the present invention, the electrophotographic photosensitive member has the support. In the present invention, the support is preferably an electro-conductive support having electric conductivity. In addition, examples of a shape of the support include a cylindrical shape, a belt shape, a sheet shape, and the like. Among those, the cylindrical support is preferable. In addition, the surface of the support may be subjected to electrochemical treatment such as anodization, blast treatment, cutting treatment, and the like.

Examples of a material of the support preferably include metal, resin, glass, and the like.

Examples of the metal include aluminum, iron, nickel, copper, gold, stainless steel, or alloys thereof, and the like. Among those, an aluminum support is preferable.

In addition, a resin or glass may have conductivity by processing such as mixing or coating with an electro-conductive material.

<Electro-Conductive Layer>

In the present invention, an electro-conductive layer may be provided on a support. By providing the electro-conductive layer, it is possible to conceal scratches or irregularities on a surface of the support or to control light reflection on the surface of the support.

The electro-conductive layer preferably contains electro-conductive particles and a resin.

Examples of materials of the electro-conductive particles include metal oxide, metal, carbon black, and the like. Examples of the metal oxide include zinc oxide, aluminum oxide, indium oxide, silicon oxide, zirconium oxide, tin oxide, titanium oxide, magnesium oxide, antimony oxide, bismuth oxide, and the like. Examples of the metal include aluminum, nickel, iron, nichrome, copper, zinc, silver, and the like.

Among those, it is preferable to use the metal oxide as the electro-conductive particles, and in particular, it is more preferable to use titanium oxide, tin oxide, or zinc oxide as the electro-conductive particles.

When the metal oxide is used as the electro-conductive particles, the surface of the metal oxide may be treated with a silane coupling agent and the like, or the metal oxide may be doped with an element such as phosphorus or aluminum or an oxide thereof.

In addition, the electro-conductive particles may have a laminated structure having core particles and a coating layer covering the particles. Examples of the core particles include titanium oxide, barium sulfate, zinc oxide, and the like. The coating layer may, for example, be a metal oxide such as tin oxide.

In addition, when the metal oxide is used as the electro-conductive particles, a volume average particle diameter is preferably 1 nm or more and 500 nm or less, and more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, an alkyd resin, and the like.

In addition, the electro-conductive layer may further contain a masking agent and the like such as silicone oil, resin particles, and titanium oxide.

An average film thickness of the electro-conductive layer is preferably 1 μm or more and 50 μm or less, and particularly preferably 3 μm or more and 40 μm or less.

The electro-conductive layer can be formed by preparing a coating solution for an electro-conductive layer containing the above-described respective materials and solvents, forming a coating film thereof, and drying the coating film. Examples of the solvents used for the coating solution include an alcohol-based solvent, a sulfoxide-based solvent, a ketone-based solvent, an ether-based solvent, an ester-based solvent, an aromatic hydrocarbon-based solvent, and the like. Examples of a dispersion method for dispersing electro-conductive particles in a coating solution for electro-conductive layer include a method using a paint shaker, a sand mill, a ball mill, or a liquid collision type high speed disperser.

<Undercoat Layer>

In the present invention, an undercoat layer may be provided on a support or an electro-conductive layer. By providing the undercoat layer, an adhesion function between the layers can be increased and a charge injection blocking function can be provided.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, a cellulose resin, and the like.

Examples of the polymerizable functional group of a monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic anhydride group, a carbon-carbon double bond group, and the like.

In addition, the undercoat layer may further contain an electron transporting substance, metal oxide, metal, an electro-conductive polymer, and the like for the purpose of enhancing electrical properties. Among those, the electron transporting substance and the metal oxide are preferably used.

Example of the electron transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, a boron compound, and the like.

The undercoat layer may be formed as a cured film by using the electron transporting substance having the polymerizable functional group as the electron transporting substance and copolymerizing with the monomer having the above-described polymerizable functional group.

Examples of the metal oxide include indium tin oxide, tin oxide, indium oxide, titanium oxide, zinc oxide, aluminum oxide, silicon dioxide, and the like. Examples of the metal include gold, silver, aluminum, and the like.

In addition, the undercoat layer may further contain an additive.

An average film thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing the coating solution for the undercoat layer containing the above-described respective materials and solvents, forming a coating film thereof, and drying and/or curing the coating film. Examples of the solvents used for the coating solution include an alcohol-based solvent, a ketone-based solvent, an ether-based solvent, an ester-based solvent, an aromatic hydrocarbon-based solvent, and the like.

<Photosensitive Layer>

A photosensitive layer of an electrophotographic photosensitive member is mainly classified into (1) a laminated type photosensitive layer and (2) a single layer type photosensitive layer. (1) The laminated photosensitive layer has a charge generating layer containing a charge generating substance, and a charge transporting layer containing the charge transporting substance. (2) The single layer type photosensitive layer has a photosensitive layer containing both the charge generating substance and the charge transporting substance.

(1) Laminated Photosensitive Layer

The laminated photosensitive layer has the charge generating layer and the charge transporting layer.

(1-1) Charge Generating Layer

The charge generating layer preferably contains a charge generating substance and a resin.

Examples of the charge generating substance include an azo pigment, a perylene pigment, a polycyclic quinone pigment, an indigo pigment, a phthalocyanine pigment, and the like. Among those, the azo pigment and the phthalocyanine pigment are preferable. Among the phthalocyanine pigments, an oxytitanium phthalocyanine pigment, a chlorogallium phthalocyanine pigment, and a hydroxygallium phthalocyanine pigment are preferable.

The content of the charge generating substance in the charge generating layer is preferably 40 mass % or more and 85 mass % or less, and more preferably 60 mass % or more and 80 mass % or less with respect to the total mass of the charge generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, a polyvinyl chloride resin, and the like. Among those, the polyvinyl butyral resin is more preferable.

In addition, the charge generating layer may further contain additives such as an antioxidant and a ultraviolet light absorber. Specifically, a hindered phenol compound, a hindered amine compound, a sulfur compound, a phosphorus compound, a benzophenone compound, and the like can be mentioned.

An average film thickness of the charge generating layer is preferably 0.1 μm or more and 1 μm or less, and more preferably 0.15 μm or more and 0.4 μm or less.

The charge generating layer can be formed by preparing a coating solution for the charge generating layer containing the above-described respective materials and solvents, forming a coating film thereof, and drying the coating film. Examples of the solvents used for the coating solution include an alcohol-based solvent, a sulfoxide-based solvent, a ketone-based solvent, an ether-based solvent, an ester-based solvent, an aromatic hydrocarbon-based solvent, and the like.

(1-2) Charge Transporting Layer

When the electrophotographic photosensitive member does not have a protection layer, the charge transporting layer is the surface layer in the present invention. That is, the charge transporting layer contains a copolymer of a composition containing a compound represented by the general formula (1) and a compound represented by the general formula (2).

The charge transporting layer preferably contains the charge transporting substance and the resin.

Examples of the charge transporting substance include a polycyclic aromatic compound, a heterocyclic compound, a hydrazone compound, a styryl compound, an enamine compound, a benzidine compound, a triarylamine compound, and a resin having a group derived from the substances thereof. Among those, the triarylamine compound and the benzidine compound are preferable.

In addition, when the electrophotographic photosensitive member has the protection layer, the surface layer in the present invention is not the charge transporting layer but the protection layer. At this time, at least one type of the charge transporting substance in the charge transporting layer has a glass transition temperature of 70° C. or higher and a content of the charge transporting substance having a glass transition temperature of 70° C. or higher is 20 mass % or more with respect to a content of all the charge transporting substances in the charge transporting layer. It is more preferable that the content of the charge transporting substance is 40 mass % or more.

It is considered that the reason is that the charge transporting layer can maintain a harder state under the low temperature and low humidity environment, and the protection layer can be the surface layer which is hardly affected by the charge transporting layer, and the effects of the present invention can be extracted more.

In addition, in a case where the electrophotographic photosensitive member has the protection layer, the charge transporting substance in the charge transporting layer does not have a substituent of an aromatic ring, or preferably has a methyl group, an ethyl group, a phenyl group, or the like as the substituent. It is considered that the reason is that the protection layer is the surface layer that is hardly affected by the charge transporting layer, and the effects of the present invention can be extracted more.

Hereinafter, Table 2 below shows exemplary compounds of the charge transporting substance.

[Table 2]
TABLE 2
| | Exemplary compound (charge transporting substance) | Glass transition temperature Tg (° C.) |
|---|---|---|
| C-1 | 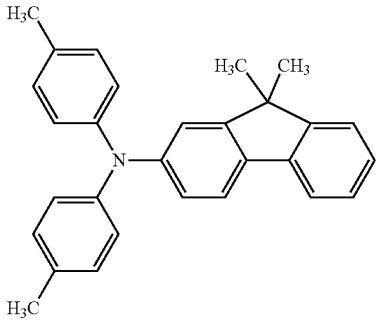 | 44 |
| C-2 | 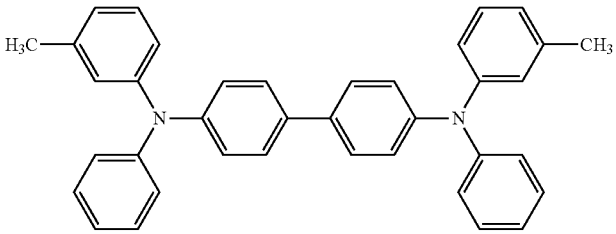 | 60 |
| C-3 | 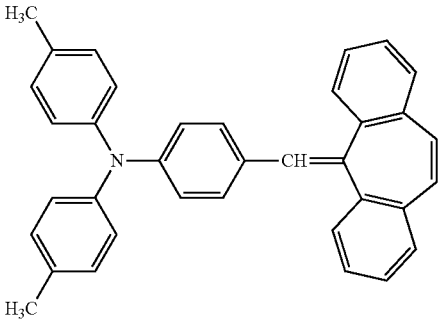 | 77 |
| C-4 | 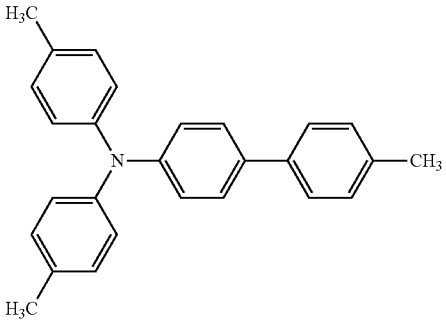 | 26 |

TABLE 2-continued

| | Exemplary compound (charge transporting substance) | Glass transition temperature Tg (° C.) |
|---|---|---|
| C-5 | 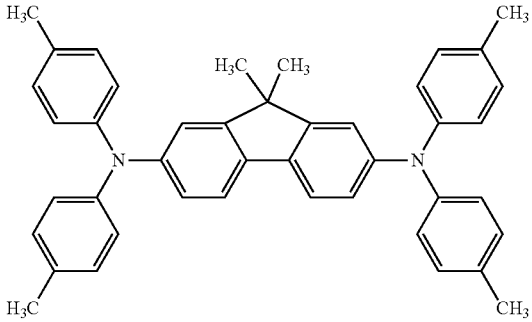 | 74 |
| C-6 | 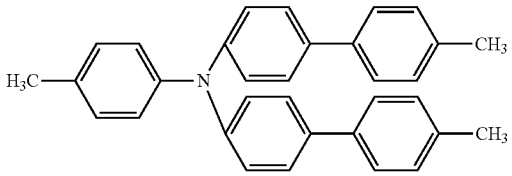 | 44 |

The content of the charge transporting substance in the charge transporting layer is preferably 35 mass % or more and 70 mass % or less, and more preferably 40 mass % or more and 55 mass % or less with respect to the total mass of the charge transporting layer.

Examples of the resin include a polyester resin, a polycarbonate resin, an acrylic resin, and a polystyrene resin, and the like. Among those, the polycarbonate resin and a polyester resin are preferable. As the polyester resin, a polyarylate resin is particularly preferable.

A content ratio (mass ratio) of the charge transporting substance and the resin is preferably 6:10 to 20:10, and more preferably 7:10 to 12:10.

In addition, the charge transporting layer may also contain additives such as an antioxidant, an ultraviolet light absorber, a plasticizer, a leveling agent, a slipperiness imparter, and an abrasion resistance improver.

Specifically, there may be a hindered phenol compound, a hindered amine compound, a sulfur compound, a phosphorus compound, a benzophenone compound, a siloxane modified resin, silicone oil, fluorine resin particles, polystyrene resin particles, polyethylene resin particles, silica particles, alumina particles, boron nitride particles, and the like.

An average film thickness of the charge transporting layer is preferably 5 μm or more and 30 μm or less, more preferably 8 μm or more and 20 μm or less, and particularly preferably 10 μm or more and 16 μm or less.

When the average film thickness of the charge transporting layer is 10 μm or more and 16 μm or less, and the electrophotographic photosensitive member has the protection layer as the surface layer, the film thickness of the surface layer is more preferably 17.0% or more and 21.5% or less with respect to the sum of the film thickness of the surface layer and the film thickness of the charge transporting layer.

This means that it is preferable that the film thickness of the charge transporting layer is the film thickness of the specific surface layer (protection layer). It is considered that the reason is that since hardness varies depending on the film thickness of the charge transporting layer under the low temperature and low humidity environment, the surface layer is hardly affected by the charge transporting layer and the effects of the present invention can be extracted more by appropriately combining the film thickness of the charge transporting layer with the film thickness of the surface layer.

The charge transporting layer can be formed by preparing a coating solution for the charge transporting layer containing the above-described respective materials and solvents, forming a coating film thereof, and drying the coating film. Examples of the solvents used for the coating solution include an alcohol-based solvent, a ketone-based solvent, an ether-based solvent, an ester-based solvent, an aromatic hydrocarbon-based solvent, and the like. Among these solvents, the ether-based solvent or the aromatic hydrocarbon-based solvent are preferable.

(2) Single Layer Type Photosensitive Layer

A single layer type photosensitive layer can be formed by preparing a coating solution for a photosensitive layer containing a charge generating substance, a charge transporting substance, a resin, and a solvent, forming a coating film thereof, and drying the coating film. The charge generating substance, the charge transporting substance, and the resin are the same as the examples of the material in the above-mentioned "(1) laminated type photosensitive layer".

When the electrophotographic photosensitive member does not have a protection layer, the photosensitive layer is the surface layer in the present invention. That is, the photosensitive layer contains a copolymer of a composition containing a compound represented by the general formula (1) and a compound represented by the general formula (2).

<Protection Layer>

The electrophotographic photosensitive member according to one aspect of the present invention may have a protection layer on the photosensitive layer. When the electrophotographic photosensitive member has the protection layer, the protection layer is a surface layer in the present invention.

As described above, the protection layer as the surface layer contains a copolymer of a composition containing the compound represented by the general formula (1) and the compound represented by the general formula (2).

The composition for forming the protection layer may also contain a compound having a polymerizable functional group other than the compound represented by the general formula (1) and the compound represented by the general formula (2). Examples of the polymerizable functional group of the compound having the polymerizable functional group include an acryloyloxy group. As the compound having the polymerizable functional group, a material having no charge transport ability may be used. Examples of a reaction method for forming a protection layer include a thermal polymerization reaction, a photopolymerization reaction, a radiation polymerization reaction, and the like.

The protection layer may also contain additives such as an antioxidant, an ultraviolet light absorber, a plasticizer, a leveling agent, a slipperiness imparter, and an abrasion resistance improver.

Specifically, there may be a hindered phenol compound, a hindered amine compound, a sulfur compound, a phosphorus compound, a benzophenone compound, a siloxane modified resin, silicone oil, fluorine resin particles, polystyrene resin particles, polyethylene resin particles, silica particles, alumina particles, boron nitride particles, and the like.

The protection layer may contain electro-conductive particles and/or a charge transporting substance, and a resin as long as the effects of the present invention are not impaired.

Examples of the electro-conductive particles include particles of metal oxides such as titanium oxide, zinc oxide, tin oxide, and indium oxide.

Examples of the charge transporting substance include a benzidine compound, a triarylamine compound, and the like.

Examples of the resin include a polyester resin, an acrylic resin, a phenoxy resin, a polycarbonate resin, a polystyrene resin, a phenol resin, a melamine resin, an epoxy resin, and the like. Among those, the polycarbonate resin, the polyester resin, and the acrylic resin are preferable.

An average film thickness of the protection layer is preferably 0.5 μm or more and 10 μm or less, and more preferably 1 μm or more and 7 μm or less.

The protection layer can be formed by preparing a coating solution for the electro-conductive layer containing the above-described respective materials and solvents, forming a coating film thereof, and drying and/or curing the coating film. Examples of the solvents used for the coating solution include an alcohol-based solvent, a ketone-based solvent, an ether-based solvent, a sulfoxide-based solvent, an ester-based solvent, an aromatic hydrocarbon-based solvent, and the like.

[Process Cartridge and Electrophotographic Apparatus]

In addition, a process cartridge according to one aspect of the present invention integrally supports the electrophotographic photosensitive member described so far and at least one unit selected from the group consisting of a charging unit, a developing unit, a transfer unit, and a cleaning unit, and is detachably attachable to a main body of an electrophotographic apparatus.

In addition, an electrophotographic apparatus according to one aspect of the present invention includes the electrophotographic photosensitive member described so far, a charging unit, an exposure unit, a developing unit, and a transfer unit.

FIGURE illustrates an example of a schematic configuration of an electrophotographic apparatus having a process cartridge provided with an electrophotographic photosensitive member.

First, reference numerals will be described.

Reference numeral 1 is an electrophotographic photosensitive member, reference numeral 2 is an axis, reference numeral 3 is a charging unit, reference numeral 4 is an exposure light, reference numeral 5 is a developing unit, reference numeral 6 is a transfer unit, reference numeral 7 is a transfer material, reference numeral 8 is a fixing unit, reference numeral 9 is a cleaning unit, and reference numeral 10 is a pre-exposure light.

Reference numeral 11 is a process cartridge and reference numeral 12 is a guide unit.

Reference numeral 1 is a cylindrical electrophotographic photosensitive member and is rotationally driven around the axis 2 in an arrow direction at a predetermined circumferential speed. A surface of the electrophotographic photosensitive member 1 is charged to a predetermined positive or negative potential by the charging unit 3. In addition, although a roller charging system using a roller type charging member is shown in the drawing, a charging system such as a corona charging system, a proximity charging system, and an injection charging system may be employed. The exposure light 4 is emitted from the exposure unit (not shown) onto the charged surface of the electrophotographic photosensitive member 1, and an electrostatic latent image corresponding to targeted image information is formed on the charged surface of the electrophotographic photosensitive member 1. The electrostatic latent image formed on the surface of the electrophotographic photosensitive member 1 is developed by a toner accommodated in the developing unit 5, and a toner image is formed on the surface of the electrophotographic photosensitive member 1. The toner image formed on the surface of the electrophotographic photosensitive member 1 is transferred to the transfer material 7 by the transfer unit 6. The transfer material 7 to which the toner image is transferred is conveyed to the fixing unit 8, subjected to fixing processing of the toner image, and printed out to an outside of the electrophotographic apparatus. The electrophotographic apparatus may have a cleaning unit 9 for removing attached matters such as a toner remaining on the surface of the electrophotographic photosensitive member 1 after the transfer. In addition, a so-called cleanerless system may be used in which the attached matter is removed using the developing unit or the like without separately providing a cleaning unit. The electrophotographic apparatus may have an antistatic mechanism for removing electricity from the surface of the electrophotographic photosensitive member 1 with the pre-exposure light 10 from the pre-exposure unit (not shown). Further, in order to detach the process cartridge 11 according to one aspect of the present invention from the main body of the electrophotographic apparatus, the guide unit 12 such as a rail may be provided.

The electrophotographic photosensitive member according to one aspect of the present invention can be used for a laser beam printer, an LED printer, a copying machine, a facsimile, a composite machine thereof, and the like.

EXAMPLE

Hereinafter, the present invention will be described in more detail with reference to Examples and Comparative Examples. The present invention is not limited to the following examples as long as the present invention does not depart from the gist. In the following description of the examples, "part" is on a mass basis unless otherwise noted.

<Production of Electrophotographic Photosensitive Member>

Example 1

An aluminum cylinder (JIS-A3003, aluminum alloy) having a diameter of 24 mm and a length of 257.5 mm was used as a support (electro-conductive support).

Next, the following materials were prepared.

214 parts of titanium oxide ($TiO_2$) particles (average primary particle diameter 230 nm) coated with oxygen deficient tin oxide ($SnO_2$) as metal oxide particles 132 parts of phenol resin (monomer/oligomer of phenol resin) as a binding material (trade name: Plyofen J-325, Dainippon Ink and Chemicals, Inc., resin solid content: 60 mass %)

98 parts of 1-methoxy-2-propanol as a solvent

These materials were placed into a sand mill using 450 parts of glass beads having a diameter of 0.8 mm, and were subjected to dispersion treatment in the conditions that a rotation speed was 2000 rpm, a dispersion treatment time was 4.5 hours, and a preset temperature of cooling water was 18° C., thereby obtaining a dispersion. Glass beads were removed from the dispersion by a mesh (mesh opening: 150 μm).

A surface roughening imparter was added to the dispersion so as to be 10 mass % with respect to a total mass of metal oxide particles in the dispersion and a binding material after the glass beads were removed. Silicone resin particles (trade name: Tospearl 120, manufactured by Momentive Performance Materials Co., Ltd., average particle diameter: 2 μm) was used as a surface roughening imparter.

In addition, silicone oil (trade name: SH28PA, manufactured by Dow Corning Toray Co., Ltd.) as a leveling agent was added to the dispersion so as to be 0.01 mass % with respect to the total mass of the metal oxide particles in the dispersion and the binding material.

Next, a mixed solvent of methanol and 1-methoxy-2-propanol (1:1 mass ratio) was added to the dispersion so that a total mass (that is, a mass of a solid content) of the metal oxide particles in the dispersion, the binding material, and the surface roughening imparter is 67 mass % with respect to the mass of the dispersion. A coating solution for an electro-conductive layer was prepared by stirring this mixture.

The support was dip-coated with the coating solution for the electro-conductive layer, and was heated at 140° C. for 1 hour to form an electro-conductive layer having a film thickness of 30 μm.

Next, the following materials were prepared.

4 parts of electron transporting substance represented by the following formula E-1

5.5 parts of blocked isocyanate (trade name: Duranate SBN-70D, manufactured by Asahi Kasei Chemicals Corporation)

0.3 parts of polyvinyl butyral resin (S-LEC KS-5Z, manufactured by Sekisui Chemical Co., Ltd.) 0.05 parts of zinc (II) hexanoate as a catalyst (Mitsuwa Chemicals Co., Ltd.)

These were dissolved in a mixed solvent of 50 parts of tetrahydrofuran and 50 parts of 1-methoxy-2-propanol to prepare a coating solution for an undercoat layer.

The electro-conductive layer was dip-coated with the coating solution for the undercoat layer, and heated at 170° C. for 30 minutes to form an undercoat layer having a film thickness of 0.7 μm.

E-1

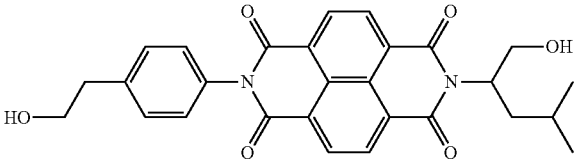

Next, the following materials were prepared.

10 parts of hydroxygallium phthalocyanine in a crystalline form having a peak at a position of 7.5° and 28.4° in a chart obtained from CuKα characteristic X-ray diffraction 5 parts of polyvinyl butyral resin (trade name: S-LEC BX-1, manufactured by Sekisui Chemical Co., Ltd.)

These materials were added to 200 parts of cyclohexanone, and dispersed for 6 hours in a sand mill apparatus using the glass beads having a diameter of 0.9 mm.

150 parts of cyclohexanone and 350 parts of ethyl acetate were further added to the mixture and diluted to obtain a coating solution for a charge generating layer. The undercoat layer was dip-coated with the obtained coating solution and dried at 95° C. for 10 minutes to form a charge generating layer having a thickness of 0.20 μm.

In addition, the measurement of the X-ray diffraction was performed under the following conditions.

[Powder X-ray Diffraction Measurement]

Measuring instrument used: X-ray diffractometer RINT-TTRII manufactured by Rigaku Denki Co., Ltd.

X-ray tube: Cu
Tube voltage: 50 KV
Tube current: 300 mA
Scan method: 2θ/θ scan
Scan speed: 4.0°/min
Sampling interval: 0.02°
Start angle (2θ): 5.0°
Stop angle (2θ): 40.0°
Attachment: Standard sample holder
Filter: Not used
Incident monochrome: Used
Counter monochrome meter: Not used
Divergent slit: Open
Divergence vertical restriction slit: 10.00 mm
Scattering slit: Open
Light receiving slit: Open
Flat panel monochrometer: Used
Counter: Scintillation counter Next, the following materials were prepared.

6 parts of charge transporting substance represented by the following formula C-1

3 parts of charge transporting substance represented by the following formula C-2

1 part of charge transporting substance represented by the following formula C-3

10 parts of polycarbonate (trade name: Iupilon Z400, manufactured by Mitsubishi Engineering-Plastics Corporation)

0.02 parts of a polycarbonate resin having copolymer unit of D-1 and D-2 (x/y=0.95/0.05:viscosity average molecular weight=20000)

These were dissolved in a mixed solvent of 25 parts of ortho-xylene/25 parts of methyl benzoate/25 parts of dimethoxymethane to prepare a coating solution for charge transporting layer. The charge generating layer was dip-coated with the coating solution for the charge transporting layer to form a coating film, and the coating film was dried at 120° C. for 30 minutes to form a charge transporting layer having a film thickness of 9 μm.

In addition, the measurement of the glass transition temperature of the charge transporting substance is performed under the following conditions. As the glass transition temperature described in the present application, a temperature at an intersection point between a tangential line in temperature range before a change point and a tangential line in a temperature range after a change point in an endothermic peak appearing at the time of a second temperature rise of 170° C. under the following temperature conditions was adopted.

[Measurement of Glass Transition Point]

Measuring instrument used: X-DSC7000 manufactured by Hitachi High-Tech Science Corporation Temperature condition:

Temperature drop from 25° C. to 0° C. at 10° C./min

Maintain at 0° C. for 5 minutes

Temperature rise from 0° C. to 170° C. at 10° C./min

Maintain at 170° C. for 5 minutes

Temperature drop from 170° C. to 0° C. at 50° C./min

Maintain at 0° C. for 5 minutes

Temperature rise from 0° C. to 170° C. at 10° C./min

Maintain at 170° C. for 5 minutes

Temperature drop from 170° C. to 25° C. at 50° C./min

Maintain at 25° C. for 5 minutes

Sample amount: 3 mg

Measurement environment: Under $N_2$ air flow

C-1

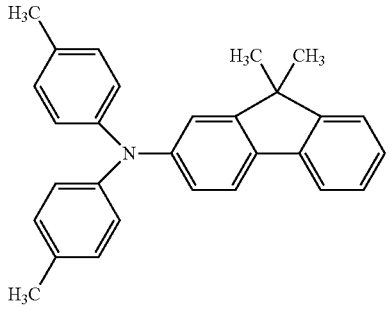

C-2

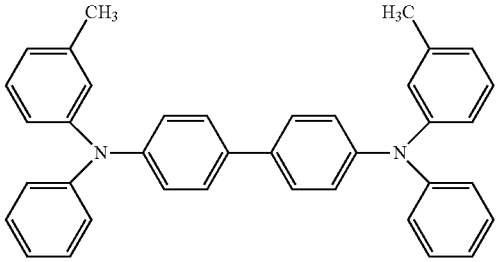

C-3

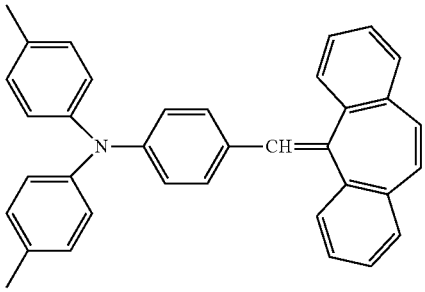

-continued

D-1

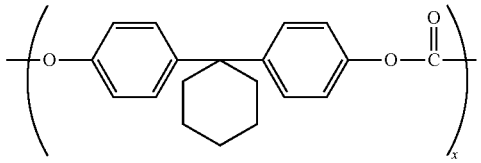

D-2

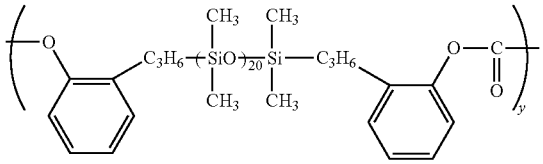

Next, the following materials were prepared.

21.7 parts of a compound 1-5 represented by the general formula (1)

9.3 parts of a compound 2-1represented by the general formula (2)

0.2 parts of siloxane-modified acrylic compound (BYK-3550, manufactured by BYK Japan KK)

These materials were mixed with a solvent of 20.7 parts of 1-propanol and 48.3 parts of cyclohexane and stirred this mixture. By doing so, the coating solution for the surface layer was prepared, and the composition containing the compound represented by the general formula (1) and the compound represented by the general formula (2) was obtained.

The charge transporting layer was dip-coated with the coating solution for the surface layer to form the coating film, and the obtained coating film was dried at 50° C. for 5 minutes. Thereafter, the coating film was irradiated with an electron beam for 1.6 seconds while the support (irradiated body) is rotated at a speed of 300 Rpm in the conditions of an acceleration voltage of 70 kV and a beam current of 5.0 mA under a nitrogen atmosphere. A dose at the surface location was 15 kGy. Thereafter, the temperature of the coating film rose to 117° C. under a nitrogen atmosphere. The oxygen concentration from electron beam irradiation to the subsequent heat treatment was 10 ppm. Next, after the coating film is naturally cooled until the temperature of the coating film was 25° C. in the atmospheric air, the coating film was subjected to heat treatment for 1 hour in the condition that the temperature of the coating film was 120° C. to obtain a protection layer as the surface layer having a film thickness of 5 μm. By doing so, the cylindrical (drum-like) electrophotographic photosensitive member having the surface layer of Example 1 was produced.

Examples 2 to 10 and 12 to 16

In Example 1, the compound represented by the general formula (1) and the compound represented by the general formula (2) were each changed as shown in Table 3. Here, a content ratio (hereinafter, referred to as a ratio of the general formula (1)) of the compound represented by the general formula (1) to a total content of the compound represented by the general formula (1) and the compound represented by the general formula (2) in the composition was changed as shown in Table 3. In addition, the total content ratio (hereinafter, referred to as the total ratio of the general formulas (1) and (2)) of the compound represented by the general formula (1) and the compound represented by the general formula (2) to a total mass of the composition was changed as shown in Table 3.

In addition, the type and mass ratio of the charge transporting substance used to form the charge transporting layer were changed as shown in Table 4.

In addition, the film thicknesses of the surface layer and the charge transporting layer and the ratio (hereinafter, referred to as an S/(S+CT) ratio) of the film thickness of the surface layer to the sum of the film thickness of the surface layer and the film thickness of the charge transporting layer were each changed as shown in Table 5.

The electrophotographic photosensitive member was produced in the same manner as in Example 1 except for the above description. In addition, the compound represented by the general formula (1) in Example 16 is a mixture of compound 1-3 and compound 1-9, and the mass ratio thereof is compound 1-3/compound 1-9=7/3.

Example 11

In Example 1, the compound represented by the general formula (1) and the compound represented by the general formula (2) used for forming the surface layer were 10.3 parts of compound 1-1 represented by the general formula (1) and 6.8 parts of compound 2-2 represented by the general formula (2), respectively. In addition, 14.0 parts of compound represented by the following formula F-1 was used for preparation of the composition. In addition, the film thicknesses of the surface layer and the charge transporting layer, and the S/(S+CT) ratio were each changed as shown in Table 5. The electrophotographic photosensitive member was produced in the same manner as in Example 1 except for the above description.

F-1

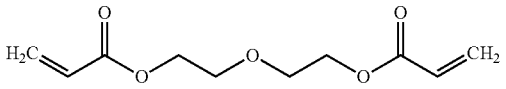

Example 17

In Example 1, the compound represented by the general formula (1) and the compound represented by the general formula (2) used for forming the surface layer were 7.4 parts of compound 1-3 represented by the general formula (1) and 17.3 parts of compound 2-1 represented by the general formula (2), respectively. In addition, 6.2 parts of compound represented by the following formula F-2 was used for preparation of the composition. In addition, the film thicknesses of the surface layer and the charge transporting layer, and the S/(S+CT) ratio were each changed as shown in Table 5. The electrophotographic photosensitive member was produced in the same manner as in Example 1 except for the above description.

F-2

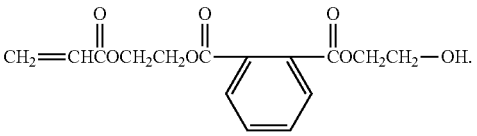

Comparative Example 1

In Example 1, the compound represented by the general formula (1) and the compound represented by the general formula (2) used for forming the surface layer were 0.03 parts of compound 1-3 represented by the general formula (1) and 30.9 parts of compound 2-2 represented by the general formula (2), respectively. In addition, the film thicknesses of the surface layer and the charge transporting layer, and the S/(S+CT) ratio were each changed as shown in Table 5. The electrophotographic photosensitive member was produced in the same manner as in Example 1 except for the above description.

Comparative Example 2

In Example 1, the compound represented by the general formula (1) and the compound represented by the general formula (2) used for forming the surface layer were 10.2 parts of compound 1-3represented by the general formula (1) and 20.7 parts of compound 2-2 represented by the general formula (2), respectively. In addition, the film thicknesses of the surface layer and the charge transporting layer, and the S/(S+CT) ratio were each changed as shown in Table 5. The electrophotographic photosensitive member was produced in the same manner as in Example 1 except for the above description.

Comparative Example 3

In Example 1, the compound represented by the general formula (1) and the compound represented by the general formula (2) used for forming the surface layer were 6.2 parts of compound 1-3 represented by the general formula (1) and 24.8 parts of compound 2-1 represented by the general formula (2), respectively. In addition, the film thicknesses of the surface layer and the charge transporting layer, and the S/(S+CT) ratio were each changed as shown in Table 5. The electrophotographic photosensitive member was produced in the same manner as in Example 1 except for the above description.

Comparative Example 4

In Example 1, the compound represented by the general formula (1) and the compound represented by the general formula (2) used for forming the surface layer were 24.8 parts of compound 1-3 represented by the general formula (1) and 6.2 parts of compound 2-1 represented by the general formula (2), respectively. In addition, the film thicknesses of the surface layer and the charge transporting layer, and the S/(S+CT) ratio were each changed as shown in Table 5. The electrophotographic photosensitive member was produced in the same manner as in Example 1 except for the above description.

Comparative Example 5

In Example 1, 20.7 parts of compound 2-2 represented by the general formula (2) was used without using the compound represented by the general formula (1). In addition, instead of the compound represented by the general formula (1), 10.2 parts of a compound represented by the following formula F-3 was used for preparation of the composition. In addition, the film thicknesses of the surface layer and the charge transporting layer, and the S/(S+CT) ratio were each changed as shown in Table 5. The electrophotographic photosensitive member was produced in the same manner as in Example 1 except for the above description.

F-3

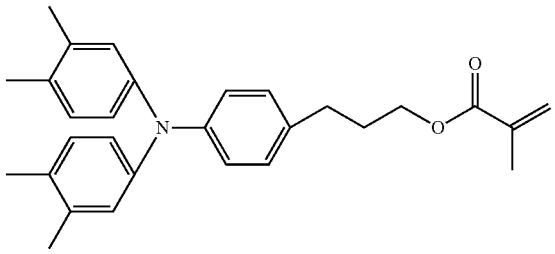

[Table 3]

TABLE 3

| | General formula (1) | General formula (2) | of 3,4-xylyl group Presence or absence | Other compounds | General formula (1) Ratio (%) | General formulas (1) and (2) Total ratio (%) |
|---|---|---|---|---|---|---|
| Example 1 | 1-5 | 2-1 | Presence | | 70% | 100% |
| Example 2 | 1-1 | 2-1 | Presence | | 70% | 100% |
| Example 3 | 1-1 | 2-1 | Presence | | 70% | 100% |
| Example 4 | 1-3 | 2-3 | Presence | | 25% | 100% |
| Example 5 | 1-3 | 2-1 | Presence | | 25% | 100% |
| Example 6 | 1-3 | 2-1 | Presence | | 25% | 100% |
| Example 7 | 1-1 | 2-2 | Presence | | 60% | 100% |
| Example 8 | 1-1 | 2-2 | Presence | | 60% | 100% |
| Example 9 | 1-1 | 2-2 | Presence | | 60% | 100% |
| Example 10 | 1-1 | 2-2 | Presence | | 60% | 100% |
| Example 11 | 1-1 | 2-2 | Presence | F-1 | 60% | 55% |
| Example 12 | 1-3 | 2-1 | Presence | | 30% | 100% |
| Example 13 | 1-3 | 2-1 | Presence | | 30% | 100% |
| Example 14 | 1-3 | 2-1 | Presence | | 30% | 100% |
| Example 15 | 1-3 | 2-1 | Presence | | 30% | 100% |
| Example 16 | 1-3/1-9 (Mass ratio 7/3) | 2-1 | Presence | | 30% | 100% |
| Example 17 | 1-3 | 2-1 | Presence | F-2 | 33% | 80% |
| Comparative Example 1 | 1-3 | 2-2 | Absence | | 0.10% | 100% |
| Comparative Example 2 | 1-3 | 2-2 | Absence | | 33% | 100% |
| Comparative Example 3 | 1-3 | 2-1 | Presence | | 20% | 100% |
| Comparative Example 4 | 1-3 | 2-1 | Presence | | 80% | 100% |
| Comparative Example 5 | — | 2-2 | Presence | F-3 | 0% | 67% |

[Table 4]

TABLE 4

| | Charge transporting Substance 1 | Charge transporting Substance 2 | Charge transporting Substance 3 | Charge transporting of substance 1 Tg(° C.) | Charge transporting of substance 2 Tg(° C.) | Charge transporting of substance 3 Tg(° C.) | Charge transporting substance ratio 1/2/3 | of Tg 70° C. or higher Charge transporting substance (%) |
|---|---|---|---|---|---|---|---|---|
| Example 1 | C-1 | C-2 | C-3 | 44 | 60 | 77 | 6/3/1 | 10% |
| Example 2 | C-1 | C-2 | C-3 | 44 | 60 | 77 | 6/2/2 | 20% |
| Example 3 | | C-2 | C-3 | | 60 | 77 | 0/6/4 | 40% |
| Example 4 | C-1 | C-2 | C-3 | 44 | 60 | 77 | 6/3/1 | 10% |
| Example 5 | C-1 | C-2 | C-3 | 44 | 60 | 77 | 6/2/2 | 20% |
| Example 6 | | C-2 | C-3 | | 60 | 77 | 0/6/4 | 40% |
| Example 7 | | C-2 | C-3 | | 60 | 77 | 0/6/4 | 40% |
| Example 8 | | C-2 | C-3 | | 60 | 77 | 0/6/4 | 40% |
| Example 9 | | C-2 | C-3 | | 60 | 77 | 0/6/4 | 40% |
| Example 10 | | C-2 | C-3 | | 60 | 77 | 0/6/4 | 40% |
| Example 11 | | C-2 | C-3 | | 60 | 77 | 0/6/4 | 40% |
| Example 12 | | C-2 | C-3 | | 60 | 77 | 0/6/4 | 40% |
| Example 13 | | C-2 | C-3 | | 60 | 77 | 0/6/4 | 40% |
| Example 14 | | C-2 | C-3 | | 60 | 77 | 0/6/4 | 40% |
| Example 15 | | C-2 | C-3 | | 60 | 77 | 0/6/4 | 40% |

TABLE 4-continued

| | Charge transporting Substance 1 | Charge transporting Substance 2 | Charge transporting Substance 3 | Charge transporting of substance 1 Tg(° C.) | Charge transporting of substance 2 Tg(° C.) | Charge transporting of substance 3 Tg(° C.) | Charge transporting substance ratio 1/2/3 | of Tg 70° C. or higher Charge transporting substance (%) |
|---|---|---|---|---|---|---|---|---|
| Example 16 | | C-2 | C-3 | | 60 | 77 | 0/6/4 | 40% |
| Example 17 | | C-2 | C-3 | | 60 | 77 | 0/6/4 | 40% |
| Comparative Example 1 | | C-2 | C-3 | | 60 | 77 | 0/6/4 | 40% |
| Comparative Example 2 | | C-2 | C-3 | | 60 | 77 | 0/6/4 | 40% |
| Comparative Example 3 | | C-2 | C-3 | | 60 | 77 | 0/6/4 | 40% |
| Comparative Example 4 | | C-2 | C-3 | | 60 | 77 | 0/6/4 | 40% |
| Comparative Example 5 | | C-2 | C-3 | | 60 | 77 | 0/6/4 | 40% |

[Table 5]

TABLE 5

| | Film thickness of surface layer (μm) | Film thickness of charge transporting layer (μm) | S/(S + CT) ratio (%) |
|---|---|---|---|
| Example 1 | 5.0 | 9.0 | 35.7% |
| Example 2 | 5.0 | 9.0 | 35.7% |
| Example 3 | 5.0 | 9.0 | 35.7% |
| Example 4 | 5.0 | 9.0 | 35.7% |
| Example 5 | 5.0 | 9.0 | 35.7% |
| Example 6 | 5.0 | 9.0 | 35.7% |
| Example 7 | 5.0 | 17.0 | 22.7% |
| Example 8 | 5.0 | 19.0 | 20.8% |
| Example 9 | 3.0 | 14.0 | 17.6% |
| Example 10 | 3.0 | 15.0 | 16.7% |
| Example 11 | 4.3 | 16.0 | 21.2% |
| Example 12 | 5.0 | 17.0 | 22.7% |
| Example 13 | 5.0 | 19.0 | 20.8% |
| Example 14 | 3.0 | 14.0 | 17.6% |
| Example 15 | 3.0 | 15.0 | 16.7% |
| Example 16 | 3.0 | 15.0 | 16.7% |
| Example 17 | 4.3 | 16.0 | 21.2% |
| Comparative Example 1 | 3.0 | 12.0 | 20.0% |
| Comparative Example 2 | 3.0 | 12.0 | 20.0% |
| Comparative Example 3 | 3.0 | 12.0 | 20.0% |
| Comparative Example 4 | 3.0 | 12.0 | 20.0% |
| Comparative Example 5 | 3.0 | 12.0 | 20.0% |

<Evaluation>

The abrasion resistance, the scratch resistance, and the occurrence of deep scratches were evaluated under the following conditions by using the electrophotographic photosensitive members of Examples 1 to 17 and the electrophotographic photosensitive members of Comparative Examples 1 to 5 which were produced.

A driving system was modified so that the rotational speed of the electrophotographic photosensitive member was 350 mm/sec by using a laser beam printer (trade name: HP Color LaserJet Enterprise M652) manufactured by Hewlett-Packard Company, as an evaluation apparatus. The evaluation apparatus was left for 7 days or more under the low temperature and low humidity environment of a temperature of 15° C. and a relative humidity of 10%. The produced electrophotographic photosensitive member was mounted on the cartridge, left for 7 days or more under the low temperature and low humidity environment, and then mounted on the evaluation apparatus, and was subjected to 10,000 sheets of continuously passing paper using an A4 test pattern of a printing rate of 1%. Thereafter, one sheet was printed with one-dot Keima (knight of Japanese chess) patterns.

The abrasion resistance was evaluated based on the degree of film loss by measuring the film thickness. The film thickness was measured under the following conditions.

Measuring instrument used: Spectral interference displacement type multilayer film thickness measuring instrument manufactured by Keyence Corporation (spectroscopic unit: SI-T80)

Measurement method: A generatrix direction and a circumferential direction of the cylindrical electrophotographic photosensitive member were measured at 1 mm intervals, and the average was taken. The measured value was a film thickness obtained by combining the charge transporting layer with the outermost surface layer, and the difference between the film thicknesses before and after continuous passing paper was calculated as the scraped amount (μm).

For the presence or absence of the occurrence of deep scratches, the image of the one-dot Keima (knight of Japanese chess) patterns was visually observed and judged based on the presence or absence of the image defects.

In addition, the scratch resistance was evaluated by measuring the surface roughness. The measurement of the surface roughness was performed under the following conditions.

Measuring instrument used: Contact stylus type surface roughness tester (trade name: SE3500) manufactured by Kosaka Laboratory Ltd.

Measurement method: Measurement was made by moving a stylus in parallel with the longitudinal direction (axial direction of the cylinder) of the support. The measurement conformed to JIS B0601 1994, and the conditions were as follows.

Measurement length: 6.0 mm
Cutoff: 0.8 mm
Stylus tip shape: Cone
Stylus tip angle: 60°
Stylus tip radius: 5 μm
Measurement speed: 0.1 mm/sec Measurement position: The electrophotographic photosensitive member was visually observed, and an Rmax value was adopted by measuring at a portion where scratches seem to be deep or a portion corresponding to a portion where there are image defects which seem to be caused by scratches on the image.

The evaluation results are shown in Table 6.

TABLE 6

| | Abrasion resistance (μm) | Scratch resistance (μm) | Presence or absence of image defect |
|---|---|---|---|
| Example 1 | 1.5 | 1.2 | Absence |
| Example 2 | 1.4 | 1.2 | Absence |
| Example 3 | 1.2 | 1.2 | Absence |
| Example 4 | 1.5 | 1.1 | Absence |
| Example 5 | 1.4 | 1.1 | Absence |
| Example 6 | 1.2 | 1.1 | Absence |
| Example 7 | 1.2 | 1.1 | Absence |
| Example 8 | 1.0 | 1.0 | Absence |
| Example 9 | 1.0 | 0.9 | Absence |
| Example 10 | 1.2 | 1.1 | Absence |
| Example 11 | 1.1 | 1.0 | Absence |
| Example 12 | 1.2 | 1.1 | Absence |
| Example 13 | 1.1 | 1.0 | Absence |
| Example 14 | 1.0 | 0.9 | Absence |
| Example 15 | 1.2 | 1.1 | Absence |
| Example 16 | 1.2 | 1.1 | Absence |
| Example 17 | 1.1 | 1.0 | Absence |
| Comparative Example 1 | 4.0 | 2.0 | Presence |
| Comparative Example 2 | 5.0 | 1.9 | Presence |
| Comparative Example 3 | 6.8 | 1.7 | Presence |
| Comparative Example 4 | 6.8 | 1.7 | Presence |
| Comparative Example 5 | 3.0 | 2.1 | Presence |

Hereinabove, as described with reference to embodiments and Examples, according to the present invention, the electrophotographic photosensitive member which has the high abrasion resistance and suppresses the occurrence of deep scratches in the repeated use under the low temperature and low humidity environment is provided. In addition, the process cartridge provided with the electrophotographic photosensitive member and the electrophotographic apparatus are provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-105583, filed May 31, 2018, which is hereby incorporated by reference herein in its entirety.

What is claimed is:

1. An electrophotographic photosensitive member comprising a support and a surface layer, wherein the surface layer contains a copolymer of a composition which contains at least a compound represented by the following general formula (1) and a compound represented by the following general formula (2), a content of the compound represented by the general formula (1) in the composition is 25 mass % or more and 70 mass % or less with respect to a total content of the compound represented by the general formula (1) and the compound represented by the general formula (2), and the total content of the compound represented by the general formula (1) and the compound represented by the general formula (2) is 55 mass % or more with respect to a total mass of the composition:

General Formula (1)

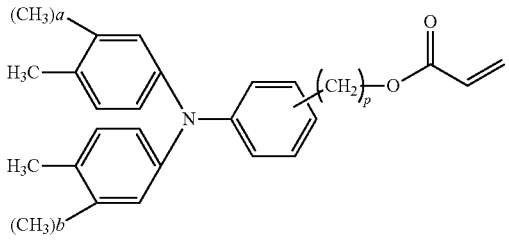

General Formula (2)

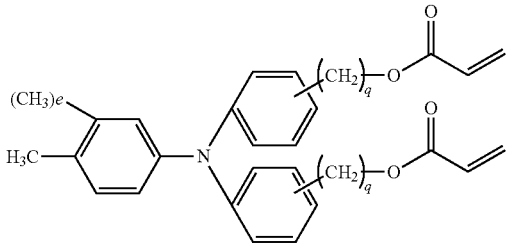

in the general formula (1), a and b are 0 or 1, p is an integer of 2 or more and 5 or less:

in the general formula (2), e is 0 or 1, q is an integer of 2 or more and 5 or less:

however, at least one of a, b, and e is 1.

2. The electrophotographic photosensitive member according to claim 1, wherein a charge generating layer, a charge transporting layer, and the surface layer are provided on the support in this order, a film thickness of the charge transporting layer is 10 μm or more and 16 μm or less, and a film thickness of the surface layer is 17.0% or more and 21.5% or less with respect to a sum of the film thickness of the surface layer and the film thickness of the charge transporting layer.

3. The electrophotographic photosensitive member according to claim 2, wherein at least one type of charge transporting substance in the charge transporting layer has a glass transition temperature of 70° C. or higher, and a content of the charge transporting substance having the glass transition temperature of 70° C. or higher is 20 mass % or more with respect to a content of all the charge transporting substances in the charge transporting layer.

4. A process cartridge integrally supporting an electrophotographic photosensitive member and at least one unit selected from the group consisting of a charging unit, a developing unit, a transfer unit, and a cleaning unit, the process cartridge being detachably attachable to a main body of an electrophotographic apparatus, wherein the electrophotographic photosensitive member includes a support and a surface layer, the surface layer contains a copolymer of a composition which contains at least a compound represented by the following general formula (1) and a compound represented by the following general formula (2), a content of the compound represented by the general formula (1) in the composition is 25 mass % or more and 70 mass % or less with respect to a total content of the compound represented by the general formula (1) and the compound represented by the general formula (2), and the total content of the compound represented by the general formula (1) and the compound represented by the general formula (2) is 55 mass % or more with respect to a total mass of the composition:

General Formula (1)

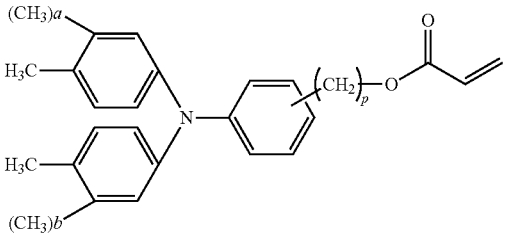

General Formula (2)

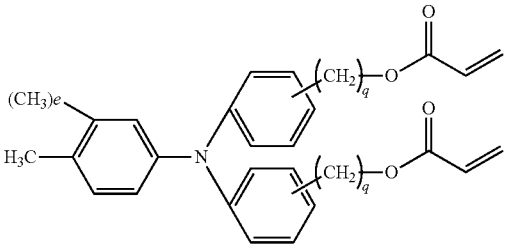

in the general formula (1), a and b are 0 or 1, p is an integer of 2 or more and 5 or less:

in the general formula (2), e is 0 or 1, q is an integer of 2 or more and 5 or less:

however, at least one of a, b, and e is 1.

5. An electrophotographic apparatus comprising an electrophotographic photosensitive member, a charging unit, an exposure unit, a developing unit and a transfer unit, wherein the electrophotographic photosensitive member includes a support and a surface layer, the surface layer contains a copolymer of a composition which contains at least a compound represented by the following general formula (1) and a compound represented by the following general formula (2), a content of the compound represented by the general formula (1) in the composition is 25 mass % or more and 70 mass % or less with respect to a total content of the compound represented by the general formula (1) and the compound represented by the general formula (2), and the total content of the compound represented by the general formula (1) and the compound represented by the general formula (2) is 55 mass % or more with respect to a total mass of the composition:

General Formula (1)

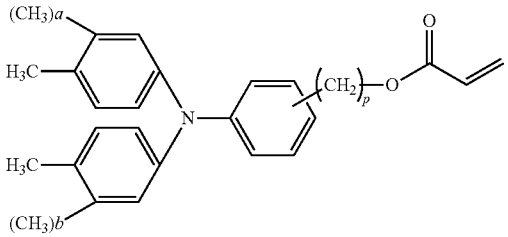

General Formula (2)

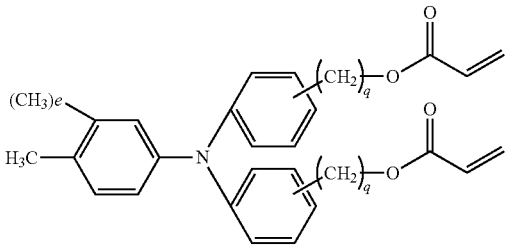

in the general formula (1), a and b are 0 or 1, p is an integer of 2 or more and 5 or less:

in the general formula (2), e is 0 or 1, q is an integer of 2 or more and 5 or less:

however, at least one of a, b, and e is 1.

* * * * *